United States Patent [19]

Giangiulio

[11] 4,025,290

[45] May 24, 1977

[54] LAMP

[76] Inventor: Clayton Giangiulio, 5 Skyline Drive, Malvern, Pa. 19355

[22] Filed: Dec. 12, 1975

[21] Appl. No.: 640,113

[52] U.S. Cl. ..... 431/324; 431/146; 431/301; 431/321; 431/344

[51] Int. Cl.[2] ..... F23D 3/18

[58] Field of Search ..... 431/298, 301, 302, 310, 431/314, 315, 320, 321, 322, 323, 324, 344, 144, 145, 146

[56] References Cited

UNITED STATES PATENTS

| | | | |
|---|---|---|---|
| 2,121,904 | 6/1938 | Currie | 431/324 X |
| 2,784,581 | 3/1957 | Quandt | 431/320 |
| 3,097,514 | 7/1963 | Stone | 431/324 |
| 3,158,015 | 11/1964 | Renwick, Sr. et al. | 431/323 |
| 3,516,774 | 6/1970 | Livingstone | 431/323 |

*Primary Examiner*—Edward G. Favors
*Attorney, Agent, or Firm*—Caesar, Rivise, Bernstein & Cohen, Ltd.

[57] ABSTRACT

A decorative lamp comprising a housing including a recess and a self-contained and replaceable mineral spirit burning lamp assembly disposed within the recess in the housing. The assembly comprises a cannister of mineral spirits into which a wick extends. A tubular portion is connected at the top of the cannister and has an open end. A cup-shaped cap member is snapped in place over the open end of the tubular portion and includes a pair of openings therein. A wick is folded in two with the folded mid portion extending outside the cap between the openings and with the free ends of the wick extending through the openings into the tubular member and therethrough into the cannister. The portion of the wick projecting out of the cap member serves as the flame site. The cap member also includes a pressure release port which is disposed adjacent to the openings through which the wick extends and is sufficiently large to permit the combustible fluid to seep therethrough as a result of the expansion thereof in the cannister when the cannister is fully filled, while small enough to preclude the fluid from gushing therethrough in the event that the cannister is inverted or otherwise knocked over.

13 Claims, 3 Drawing Figures

LAMP

The instant invention relates generally to replaceable combustible fluid burning assemblies for use in lamp housings.

Heretofore various combustible fluid lamp assemblies have been disclosed in the prior art and some are commercially available. Such lamp assemblies comprise heads which normally include means for holding the tip of a wick in an extended position to provide a flame site while enabling the remaining portion of the wick to extend into a reservoir of combustible fluid to provide the fluid to the flame site.

While such devices may be effective in providing light, they are generally unsatisfactory for use as table lamps in restaurants due to their expense and complexity and the costs involved in refilling them.

In U.S. Pat. No. 3,321,938 (Bureau) there is disclosed a flame controlled oil burner assembly which is of a generally simple construction and design so as to be suitable for decorative lighting purposes such as table lamps for restaurants. The burner of the U.S. Pat. No. 3,321,938 is arranged to ensure that the wick tip projects a predetermined distance from the device and is maintained in that position to provide a stable and efficient flame site. To that end, there is disclosed an oil burner head which comprises a wick which fits into a terminal piece formed as a cylindrical tubular member. The wick extends through the terminal piece and projects out one end thereof a predetermined length. The portion of the tubular piece at the projecting wick portion is crimped to hold the wick in place and thereby preserve the length of projection thereof. The terminal piece with the wick therein is mounted in an elongated body which has an axial bore to form a passage which terminates at one end thereof in an enlargement. Due to the crimping of the terminal piece a channel is formed on each side of the terminal piece at right angles thereto and communicating with the passage.

While the device of the U.S. Pat. No. 3,321,938 is generally effective for maintaining the proper exposure of the wick to produce the desired flame height, the device suffers from several disadvantages. The most serious of those disadvantages appears to be the necessary result of the construction of the wick holding components. That is, since the wick tip holding tubular member is crimped or flattened it creates substantially large transverse channels adjacent thereto, which channels although obstensibly provided for the return flow of excess fluid to the container, nevertheless enable substantial amounts of oil to seep or otherwise flow out of the channels to accumulate at the tip. This seepage usually occurs as a result of expansion of the fluid when the container is fully filled or if the container is inverted or otherwise knocked over. In addition to being messy, the presence of excess fluid in the vicinity of the wick tip may impede the lighting thereof.

Accordingly, it is a general object of the instant invention to provide a fluid burning assembly for lamps which overcomes the disadvantages of the prior art.

It is a further object of this invention to provide a fluid burning assembly for lamps which includes means for maintaining the proper wick exposure to provide a stable and efficient flame site.

It is still a further object of this invention to provide in a combustible fluid burning assembly for lamps wherein the fluid is held within a cannister, means for supporting the tip of a wick and arranged to permit fluid to seep out of the cannister in the event that the fluid expands to a larger volume than the cannister but to preclude appreciable fluid from gushing therethrough in the event that the cannister is inverted or otherwise knocked over.

It is yet a further object of this invention to provide a replaceable combustible fluid burning assembly including extremely simple means for supporting a wick tip.

These and other objects of the instant invention are achieved by providing in a fluid burning lamp a cannister of combustible fluid into which a wick extends. A top assembly is provided for the cannister for holding a portion of the wick a predetermined distance away from the assembly to provide a flame site. The assembly comprises a tubular portion connected at the top of the cannister and having an open end. A cap member covers the open end and includes a pair of openings therein. The wick is folded in two with the folded midportion extending outside the cap between the openings and with the free ends of the wick extending through the tubular member and into the fluid within the cannister. The cap member also comprises a pressure release port disposed adjacent to the openings and being sufficiently large to permit fluid to seep therethrough in the event that the fluid expands to a volume greater than that of the cannister while being small enough to preclude the fluid from gushing therethrough in the event that the cannister is knocked over.

Other objects and many of the attendant advantages of the instant invention will be readily appreciated as the same becomes better understood by reference to the following detailed description when considered in connection with the accompanying drawings wherein.

Figure 1:
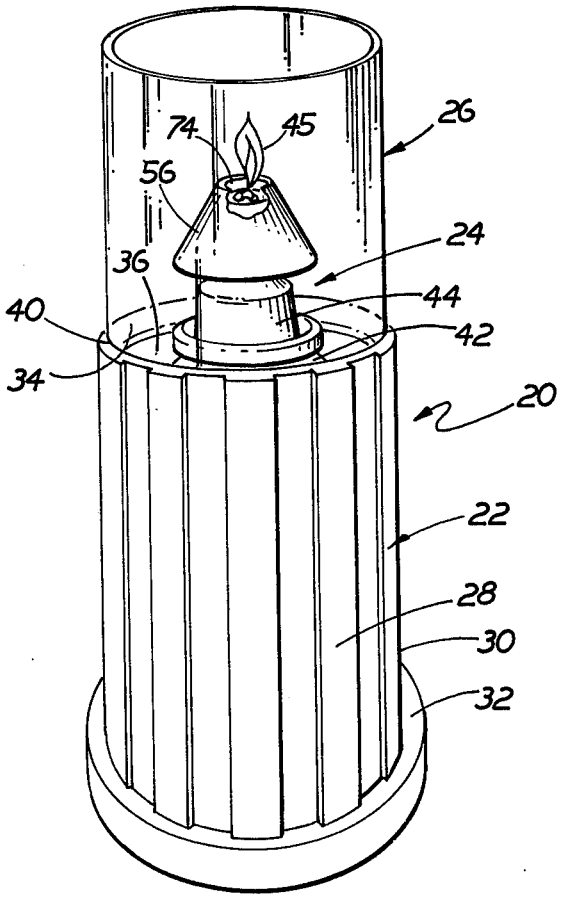
FIG. 1 is a perspective view of a lamp particularly suited for use on tables in restaurants and including a replaceable burner assembly in accordance with the instant invention.

Referring now to the various figures of the drawing wherein like reference characters refer to like parts, there is shown in FIG. 1 a decorative lamp of simple construction and aesthetically pleasing simple design for use as a table lamp for various applications such as in dining facilities, restaurants, nightclubs, etc. The lamp basically comprises a hollow housing 22 for receipt of a burner assembly 24 therein and a transparent or translucent light transmitting cover 26 mounted on the housing 22 and adjacent the flame site so that the light produced at the flame site passes therethrough for illuminating the surrounding area.

It should be pointed out at this juncture that the shape or design of the housing and/or the cover 26 can be selected as desired and that insofar as the drawing herein is concerned, the design is merely exemplary. All that is required of the lamp shape and design is that its housing be adapted for receiving the burner assembly 24 therein.

As can be seen in FIG. 1, the housing 22 comprises a cylindrical portion 28 having a side wall 30 and a closed base wall 32. The diameter of the base wall is slightly larger than the diameter of the side wall 30 so as to provide a stable platform for the housing. The top end 34 of the tubular portion 28 is open so as to enable the burner assembly 24 to be inserted within the interior or recess 36 in the housing. The height of the housing 28 is dimensioned such that the upper end of the burner assembly 24, which end serves as the flame site of the burner assembly, extends beyond the top peripheral edge 40 of the tubular housing 28. A transparent or translucent shell 26, serving as a light disipator is mounted within the interior of the tubular portion 28 at the top peripheral edge 40. The shell 26 may be either transparent, translucent and/or colored and can have either a smooth or a textured surface, depending upon design or aesthetic considerations.

In accordance with the embodiment of the lamp housing shown in FIG. 1 the shell 26 is held in place by frictional engagement with the peripheral edge 40 of the housing 28, although other positioning and securement means can be utilized, if desired.

In accordance with the preferred embodiment of the instant invention the burner assembly is a replaceable unit and includes a cannister 42 having a combustible fluid, such as mineral spirits, 43, therein. A top assembly 44 is connected at the upper end of the cannister 42 and includes means (to be described later) for supporting a flame 45 thereat.

Figure 2:
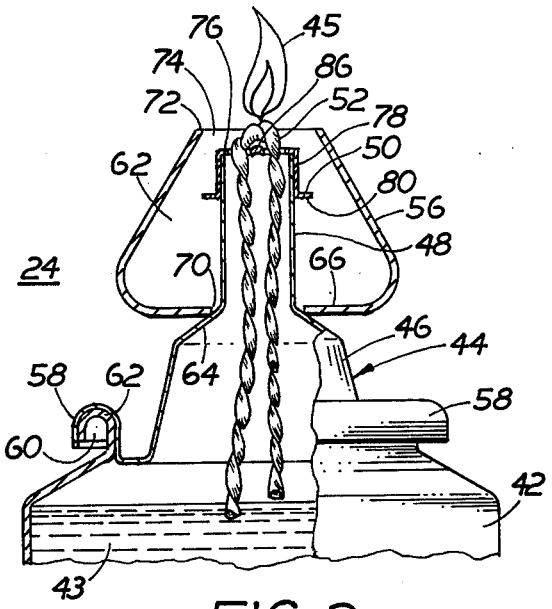
FIG. 2 is an enlarged side elevational view, partially broken away, of the burner assembly shown in FIG. 1.

The details of the top assembly 44 and the connection thereof to the cannister 42 is shown in more detail in FIG. 2. To that end, as can be seen, the top assembly 44 basically comprises a hollow crown 46 including a projecting tubular portion 48 having an opening 49 (FIG. 3), a wick 52 extending through said tubular portion 48, said crown 46, and into the combustible fluid within the cannister 42, a cap 50 closing the open end 49 of the tubular portion 48 and holding a portion of the tip of the wick at an extended position with respect thereto to provide a flame site and automatic snuffer means 56.

The hollow crown 46 includes a U-shaped peripheral flange 58 forming a downturned annular recess 60. The recess is adapted to receive the flanged lip 62, which forms the opening of a conventional fluid holding cannister, in order to seal the contents 43 therein. The portion of the crown 46 from which the tubular portion 48 extends includes a conically tapered surface 64. This surface coacts with the snuffer means 56 in a manner, to be described hereinafter, to enable the snuffer 56 to effect the automatic extinguishment of the flame 45 in the event that the burner assembly is suddenly bumped or inverted.

It s to be pointed out at this juncture that the snuffer means 56 described herein is constructed in accordance with the teachings of my U.S. Pat. No. 3,885,905, whose disclosure is incorporated by reference herein.

Referring now to FIG. 2 it can be seen that the snuffer means 56 is a hollow member of generally conically shape and comprises a base wall 66 and a side wall 68. The base wall is a planar circular member and includes a central opening 70 at its center. The side wall 68 projects generally inwardly from the periphery of the base wall. The free end of the side wall 68 is denoted by the reference numeral 72 and defines an enlarged central opening 74 which is axially aligned with the opening 70 in the base wall 66 but is of greater diameter. The snuffer 56 is mounted on the top assembly 44 with the tubular portion 48 extending through the opening 70 in the base wall 66 of the snuffer and with the portion of the base wall of the snuffer contiguous with the opening 70 abutting a portion of the tapered surface 64 of the crown 46 closely adjacent to the extending tubular portion 48.

The cap 50 serves to support the tip of the wick a predetermined distance thereabove so as to provide a site for the flame 45. When the burner assembly is its stable upright orientation like that shown in FIGS. 1 and 2 the periphery of the central opening 70 in the bottom wall of the snuffer abuts the portions of the of the conical surface 64 of the cap member contiguous with the tubular portion 48 and the base wall of the snuffer is horizontal, such that the enlarged opening 74 of the snuffer is disposed over the extending wick tip. With the snuffer in this position, hereinafter referred to as the normal position, the entire wick tip is exposed and uncovered which enables the combustion of the fuel to occur uninterrupted at the wick tip to produce and maintain the flame 45 thereat.

The tapered surface 64 of the crown 46 serves as a pivot surface about which the snuffer rotates eccentrically when the burner assembly is suddenly impacted. For example, if the burner is suddenly impacted by nevertheless remains generally upright the snuffer 56 begins to spin eccentrically about the tubular portion 48, whereupon the peripheral portion of the side wall 68 overlies the wick tip thereby interrupting the combustion of fuel at the wick tip to result in the rapid extinguishment of the flame. Furthermore, if the impaction of the burner actually results in its overturning to a horizontal position, the loose coupling between the snuffer 56 and the crown 46 enables the snuffer to pivot downwardly about the extending tubular portion 48, whereupon the uppermost portion of the snuffer is furthest away from the crown while the lowermost portion of the snuffer is closest thereto. In such an orientation portions of the snuffer's side wall 68 and base wall 66 overly the wick tip, thereby interrupting the combustion of the fuel at the wick tip and extinguishing the flame.

Figure 3:
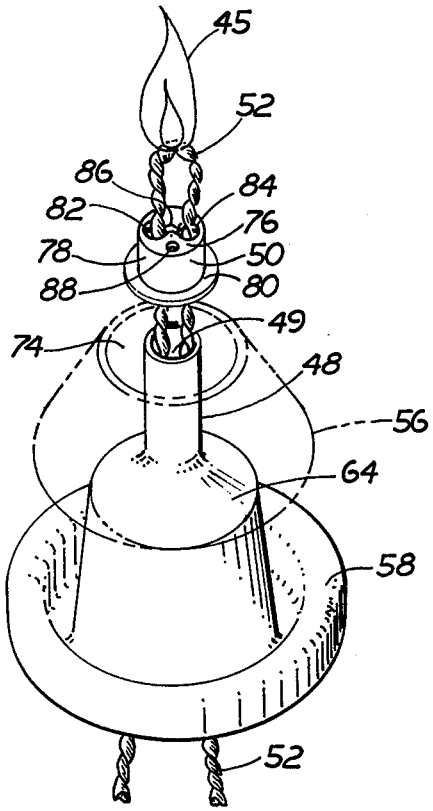
FIG. 3 is an enlarged exploded perspective view of the top portion of the burner assembly of the instant invention.

The cap member 50, as can be seen in FIGS. 2 and 3, is a cup-shaped member having a planar top wall 76, a circular side wall 78 and a peripheral flange 80 extending normally about the bottom edge of the circular side wall. The cap 50 is hollow, with the internal diameter thereof being dimensioned such that the cap fits snuggly on the tubular portion 48 to close the open end 49 thereof. The flange is slightly larger in diameter than the opening 70 in the bottom wall 66 of the snuffer so as to prevent the snuffer from falling off the central tubular portion 48 in the event that the burner assembly is inverted.

The cap member 50, as noted heretofore, is arranged to hold the wick in place while maintaining a predetermined length portion thereof extending out of the cap to provide a flame site. To that end, as can be seen, the wick 52 is a braided member which is folded at a mid-portion thereof so as to form the exposed tip 52. The cap member 50 includes a pair of openings 82 nd 84 therein. The two leg portions of the wick formed by the folding thereof from mid-portion 52 extend through respective openings 82 and 84 in the cap member, through the connected tubular portion 48, the crown 46 and into the combustible fluid 43 within the cannister 42. The diameter of each of the openings 82 and 84 is sufficiently small so as to provide frictional engagement with the wick to aid in hold the wick in place with the tip portion 52 extended by the predetermined amount to provide proper combustion at the flame site. As can be seen in FIGS. 2 and 3, the portion of the top wall 76 of the cap member 50 between the openings 82 and 84 is dimpled so as to provide a convex surface 86. This surface extends above the plane of top wall 76 so as to provide additional exposure of the wick tip 52, that is, it prevents the wick tip from lying too close to the top wall 76 of the cap 50, to permit optimum combustion.

In accordance with the preferred embodiment of the invention a pressure release port 88 is provided within the top wall 76 of the cap 50. This port is disposed closely adjacent to the openings 82 and 94 and is dimensioned to be sufficiently large (e.g. 0.8 mm) to permit the combustible fluid 43 to seep thereout in the event that the fluid in the cannister 42 expands to a volume greater than that of the cannister, while being small enough to preclude the fluid from gushing therethrough in the event that the cannister 42 is knocked over.

Without further elaboration, the foregoing will so fully illustrate my invention that others may, by applying current or future knowledge, readily adopt the same for use under various conditions of service.

What is claimed as the invention is:

1. In a fluid burning lamp comprising a cannister of combustible fluid into which a wick extends, a top assembly for said cannister for holding a portion of said wick a predetermined distance away from said assembly to provide a flame site, said assembly comprising a tubular portion connected at the top of said cannister and having an open end and a cap member covering said end and including a pair of openings therein, with a web portion between said openings, said web portion including a projecting surface, said wick folded in two at a mid-portion thereof with said mid-portion extending outside said cap between said openings and with the free ends of the wick extending through said tubular member and into the fluid within said cannister, the projecting surface of said web portion supporting the top of said wick a predetermined distance from the cap member, said cap member also comprising a pressure release port disposed adjacent to said openings and being sufficiently large to permit fluid to seep therethrough in the event that said fluid expands to a volume greater than that of the cannister while being small enough to preclude fluid from gushing therethrough in the event that the cannister is knocked over.

2. In the lamp of claim 2 wherein said cap member is cup-shaped and snaps over the open end of said tubular portion.

3. In the lamp of claim 2, said assembly additionally comprising automatic snuffer means coupled thereto.

4. In the lamp of claim 3 wherein said snuffer means is a hollow member including an opening through which said tubular portion of said assembly extends, said snuffer means being loosely coupled to said portion such that when the cannister is impacted suddenly or knocked over, a portion of the snuffer means overlies the exposed wick portion to extinguish the flame thereat.

5. A fluid burning lamp assembly for disposition within a decorative housing comprising a cannister of combustible fluid into which a wick extends, a tubular portion connected at the top of said cannister and having an open end and a cap member covering said end and including a pair of openings therein, with a web portion between said openings, said web portion including a projecting surface, said wick being folded into two at a mid-portion thereof with said mid-portion extending outside said cap between said openings and with the free ends of the wick extending through said tubular member and into the fluid within said cannister, the projecting surface of said web portion supporting the top of said wick a predetermined distance from the cap member, said cap member also comprising a pressure release port disposed adjacent to said openings and being sufficiently large to permit fluid to seep therethrough in the event that the fluid expands to a greater volume than the cannister, while being small enough to preclude fluid from gushing therethrough in the event that said cannister is knocked over.

6. In the lamp of claim 5 wherein said cap member is cup-shaped and snaps over the open end of said tubular portion.

7. In the lamp of claim 6, said assembly additionally comprising automatic snuffer means coupled thereto.

8. In the lamp of claim 7 wherein said snuffer means is a hollow member including an opening through which said tubular portion of said assembly extends, said snuffer means being loosely coupled to said portion such that when the cannister is impacted suddenly or knocked over, a portion of the snuffer means overlies the exposed wick portion to extinguish the flame thereat.

9. The assembly of claim 8 wherein said fluid is mineral spirits.

10. A decorative lamp comprising a decorative housing including a recess and a fluid burning lamp assembly disposed within said recess and comprising a cannister of cobustible fluid into which a wick extends, a tubular portion connected at the top of said cannister and having an open end and a cap member covering said end and including a pair of openings therein, with a web portion between said openings, said web portion including a projecting surface, said wick being folded in two at a mid-portion thereof with said mid-portion extending outside said cap between said openings and with the free ends of the wick extending through said tubular member an into said cannister, the projecting surface of said web portion supporting the top of said wick a predetermined distance from the cap member, said cap member also comprising a pressure release port disposed adjacent to said openings and being sufficiently large to permit fluid to seep therethrough in the event that the fluid expands to a greater volume than the volume of said cannister, while being small enough to preclude fluid from gushing therethrough in the event that said cannister is knocked over.

11. In the lamp of claim 10 wherein said cap member is cup-shaped and snaps over the open end of said tubular portion.

12. In the lamp of claim 11, said assembly additionally comprising automatic sniffer means coupled thereto.

13. In the lamp of claim 12 wherein said snuffer means is a hollow member including an opening through which said tubular portion of said assembly extends, said snuffer means being loosely coupled to said portion such that when the cannister is impacted suddenly or knocked over, a portion of the snuffer means overlies the exposed wick portion to extinguish the flame thereat.

* * * * *